US005350057A

United States Patent [19]

Bemis et al.

[11] Patent Number: 5,350,057

[45] Date of Patent: Sep. 27, 1994

[54] DISPLAY DEVICE

[75] Inventors: Peter F. Bemis, Sheboygan; Timothy J. Otte, Sheboygan Falls, both of Wis.

[73] Assignee: Bemis Manufacturing Company, Sheboygan Falls, Wis.

[21] Appl. No.: 70,723

[22] Filed: Jun. 2, 1993

[51] Int. Cl.[5] ..... B65D 5/52

[52] U.S. Cl. ..... 206/44 R; 206/44 K; 229/5.7; 312/107; 312/108

[58] Field of Search ..... 206/44 R, 44 K, 44.11; 229/5.7; 220/323, 326, 324; 312/107, 108, 114, 118, 109, 138.1

[56] References Cited

U.S. PATENT DOCUMENTS

| | | | |
|---|---|---|---|
| 1,849,659 | 3/1932 | Burks . | |
| 2,075,131 | 3/1937 | Parkinson | 229/5.7 |
| 2,562,326 | 7/1951 | Moremen | 206/44 K |
| 3,494,685 | 2/1970 | Fiterman et al. | 312/108 |
| 3,851,936 | 12/1974 | Muller | 312/108 |
| 3,860,309 | 1/1975 | Brendgord | 312/108 |
| 3,990,752 | 11/1976 | Hoffman et al. | 206/44 R |
| 4,239,306 | 12/1980 | Klaus | 312/108 |
| 4,423,913 | 1/1984 | Lee | 312/118 |
| 4,708,240 | 11/1987 | McMahon et al. | 206/45.18 |
| 4,807,756 | 2/1989 | Young et al. | 206/509 |
| 4,826,008 | 5/1989 | Cloosterman | 229/5.7 |
| 4,844,566 | 7/1989 | Moore et al. | 312/108 |
| 4,911,321 | 3/1990 | Borchardt | 220/23.83 |
| 4,969,568 | 11/1990 | Yoshida | 220/22.3 |
| 5,100,324 | 3/1992 | Slayton | 206/1.7 |

*Primary Examiner*—David T. Fidei

*Attorney, Agent, or Firm*—Michael, Best & Friedrich

[57] ABSTRACT

A display device that can be used singularly for securing a single open-faced container on a shelf for display of and access to the container contents or in multiples to secure any number of like open-faced containers on a shelf for display of and access to the contents of each container. The display device includes a frame defining an access opening. The frame is dimensioned to surround the open face of the container on which the frame is to be mounted. The display device further includes a releasable lock for removably securing the frame to the open-faced container, and an anchor for attaching the frame to the shelf when the display is in use.

27 Claims, 2 Drawing Sheets

Fig. 1
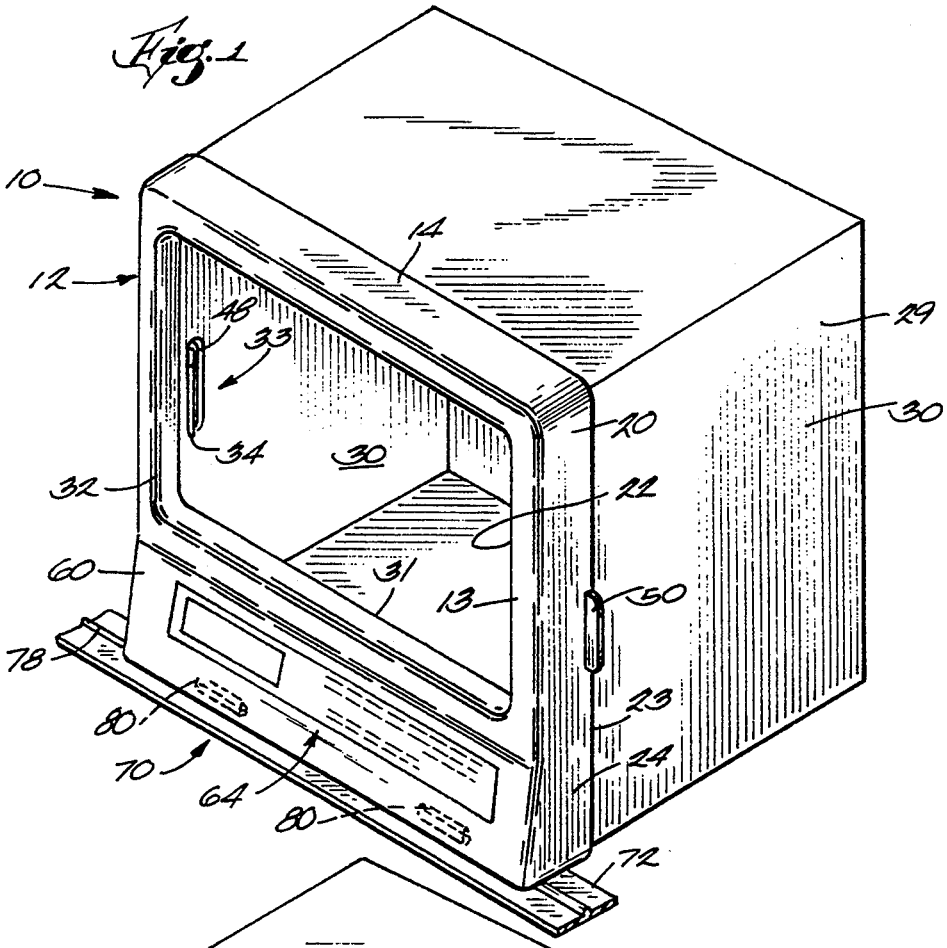
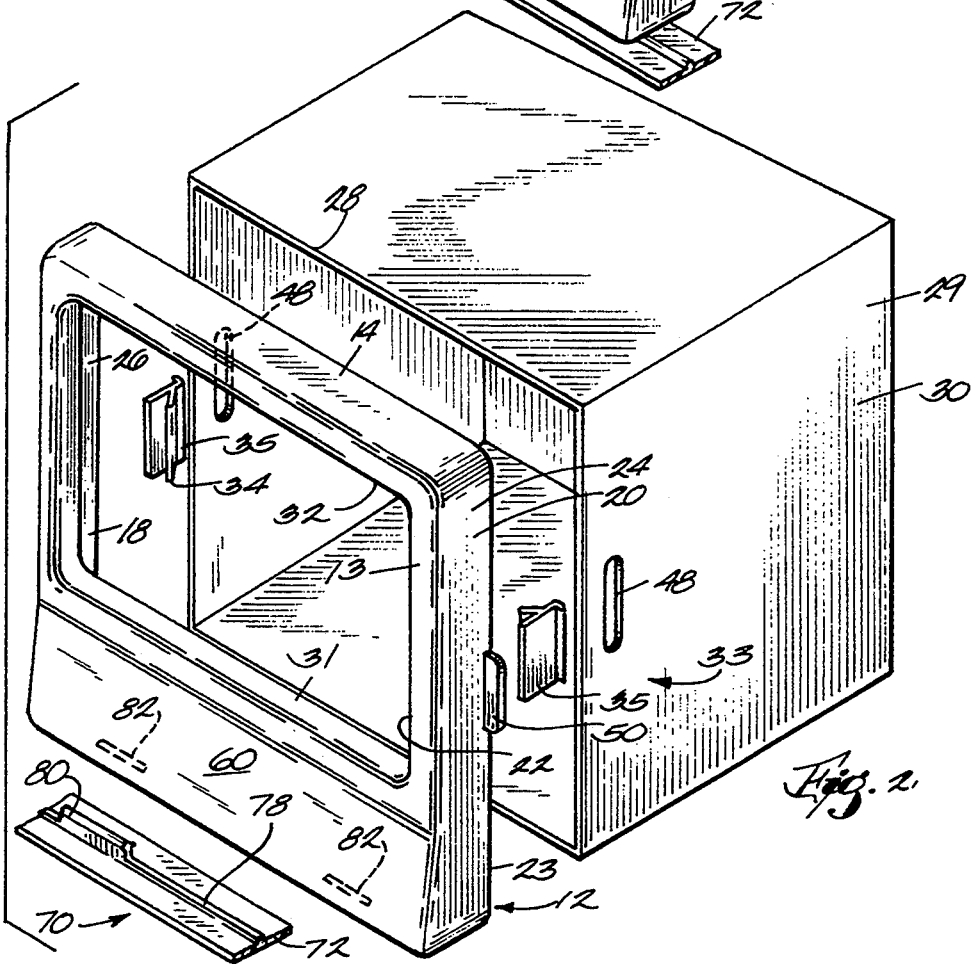
Fig. 2.

DISPLAY DEVICE

BACKGROUND OF THE INVENTION

1. Field of the Invention

This invention relates to a point of sale display device including an open-faced product shipping container or plurality of like containers on a shelf in order to provide customer access to the products within the container or containers.

2. Description of Related Art

In displaying products at a point of sale location it is known for merchants to take a shipping container such as a cardboard box which holds a plurality of individual products, remove the top lid or cut off a top portion to provide an open face on the box, and then place the box on a shelf for access by customers. The box is usually placed on a shelf with its open face vertically disposed toward the customer to make product access more convenient. The box is free to shift inwardly, outwardly and sideways on the shelf. In removing products from the box the customer can inadvertently shift the box outwardly, causing it to fall off the shelf, or move the box laterally, which may cause it to contact and dislodge an adjacent box or boxes. A falling box offers potential for injury and the impact of the fall may result in damage to the products in the box.

In order to minimize such problems many merchants do not place an open-faced shipping box directly on a shelf. Most often the products are removed from their shipping box and stacked individually or placed in product holding bins on shelves. Either of these alternatives is more labor intensive and therefore more costly than simply placing open-faced shipping containers with the products therein directly onto shelves.

Known product displays stack open-faced containers at a point of purchase. It is, for example, known from U.S. Pat. Nos. 1,849,659 and 4,708,240, to provide display devices for supporting open-faced containers in vertically stacked, stepped-back relation to each other. The display supports of these prior patents are not adapted for removably securing individual open-faced product shipping containers on a standard horizontal shelf.

SUMMARY OF THE INVENTION

The invention provides a display device that can be used singularly for securing a single open-faced container on a shelf for display and access to the container contents. The device can also be used in multiples to secure any number of like open-faced containers on a shelf. The display device comprises a frame having an access opening. The frame is dimensioned to surround the open face of a container.

A releasable locking means is provided on the frame for removably securing the frame to the container. The releasable locking means may include a detent that projects in cantilever fashion from the frame for a distance that will enable the detent to engage an opening in the side of the container.

An anchor means is provided for attaching the frame to the shelf when the display is in use. The anchoring means preferably includes a base member having upper and lower sides. A bayonet on the upper side of the base member is releasably received within an aperture in the display frame. The lower side of the base member is provided with an attaching device such as an adhesive strip for attaching the base member to the shelf.

Preferably, the frame includes top, bottom and side walls, with the releasable locking means being secured on the inner surface of each of the side walls. The frame preferably also includes a front wall which extends between the frame side walls and which defines the access opening. The front wall extends across the lower part of the container opening so as to retain items within the container while affording access to the items. The product name, trademark, price and other information regarding the product can be prominently displayed on the front wall of the frame.

A disadvantage of removing the top of a shipping box and placing the box on a shelf resides in the fact that such information regarding the product is not prominently displayed at a proper location on the box for convenient reading by the customer. Being able to view the individual product packages inside the box will not overcome this shortcoming when the product packages are small. With small packages the printed information is not easily read unless the customer is very close to the shelf. In those instances where the product is packed in bulk in the box, trademarks or product names are frequently not on the individual products or, if they are, they are not easily seen by the customer. The display device embodying the invention solves these problems.

Another advantage of the invention is the provision of a display device that substantially prevents the container from shifting on the shelf.

Another advantage of the invention is the provision of a display device that retains items in the container while affording access to the items.

Other features and advantages of the invention will become apparent to those skilled in the art upon review of the following description, claims and drawings.

BRIEF DESCRIPTION OF THE DRAWINGS

FIG. 1 is a perspective view of the display device mounted on an open-faced shipping container.

FIG. 2 is an exploded perspective view of the display device shown in FIG. 1.

DESCRIPTION OF THE PREFERRED EMBODIMENT

Figure 4:
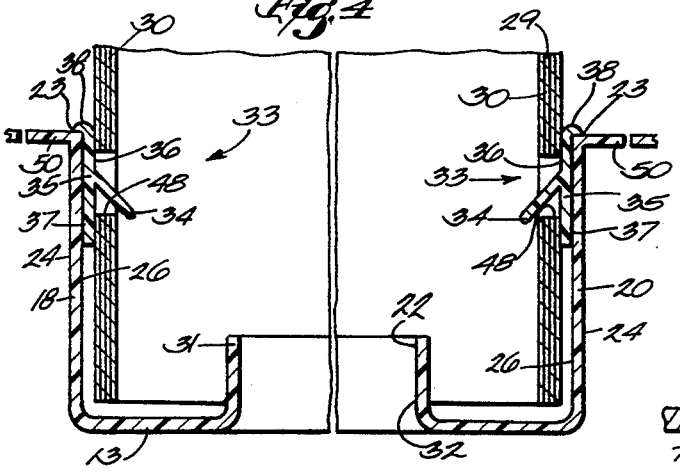
FIG. 4 is a partial sectional view taken along line 4—4 of FIG. 3.

A display device 10 embodying the invention is illustrated in the drawings. Referring to FIGS. 1, 2 and 4, the display device 10 includes a plurality of frames 12. Each frame 12 has a front wall 13, a top wall 14, a bottom wall 16 (FIG. 5), and side walls 18 and 20. The front wall 13 defines an access opening 22. Each side wall has a rearward edge 23. Each of the top, bottom and side walls has outer and inner surfaces 24 and 26. The inner surfaces 26 are dimensioned so as to surround the open face 28 (FIG. 2) of a box or container 29 having opposed side walls 30. Preferably, the frame 12 includes an inner margin 31 that extends rearwardly from the front wall 13, that is spaced from the top, bottom and side walls 14, 16, 18 and 20, and that cooperates with the front wall 13 to define the access opening 22. The inner margin 31 extends a short distance towards the interior of the container 29, and the margin 31 and the front wall 13 intersect to form a rounded peripheral edge 32 that is substantially harmless if accidently contacted by a customer.

The frame 12 further includes (see FIGS. 2 and 4) a releasable locking means 33 for securing the frame 12 to the container 29. The releasable locking means 33 is located on each of the side walls 18 and 20 of the frame 12. Each releasable locking means 33 includes a detent 34. The detent 34 projects forwardly and inwardly in cantilever fashion from the inner surface 26 of the frame side wall, preferably at an angle of approximately 45 degrees. The detent 34 may be formed integrally with the frame 12, but preferably is defined by a clip member 35. The clip member 35 includes (see FIG. 4) an inner or support surface 36 and an outer surface 37. The detent 34 extends from the support surface 36. The clip member 35 also includes a gauging means in the form of an outwardly projecting bead member 38. When the clip member 35 is properly located on the frame 12, the bead 38 registers with the rear edge 23 of the frame side wall. This automatically locates the detent 34 at a predetermined position in facing relation to the side wall 30 of the container 29. The outer surface 37 of the clip member 35 is secured to the inner surface 26 of the frame side wall 18 or 20 by any suitable means such as an adhesive.

Each side wall 30 of the container 29 includes (see FIGS. 2 and 4) a recess such as an elongated slot or depression 48, with the predetermined position of the associated detent 34 being such that the detent 34 extends into the slot 48 when the frame 12 is mounted on the container 29. Such engagement of the detents 34 and the slots 48 releasably secures the frame 12 to the container 29. The angle of the detents 34 facilitates sliding the frame 12 over the open face of the container 29. Preferably, the side walls 30 of the container are deflected inwardly by the detents 34 until the detents become aligned with the slots 48, at which point the detents 34 "pop" into the slots 48 (or, more accurately, the side walls 30 of the container move outwardly so that the detents extend into the slots).

Some shipping containers are provided with hand holes for convenient handling. If desired the detent 34 can be sized and located to fit the hand hole of a shipping container. Instead of having the detents 34 be rigid, the container walls can be rigid and the detents can be flexible, deflectable members. Also, rather than having recesses or slots in the container walls, the detents 34 can have sharp ends that bite into the container walls 30 to retain the frame 12 on the container.

As shown in FIGS. 1–4, a tab element 50 extends from the outer surface 24 of each frame side wall 18 or 20 and projects away from the frame access opening 22. The tab elements 50 provide a gripping area for use in releasing the detents 34 from the slots 48 as will be more fully explained hereinafter.

Figure 5:
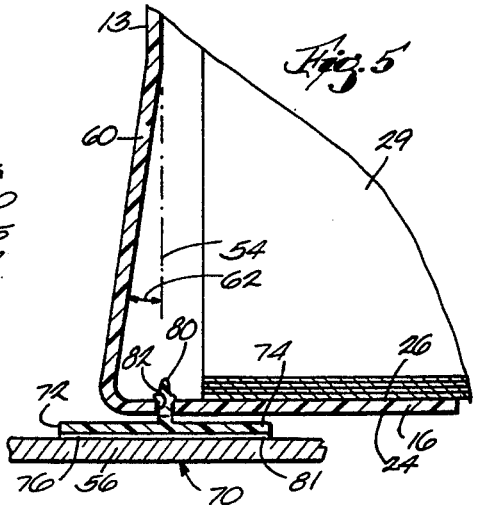
FIG. 5 is a partial sectional view taken along line 5—5 of FIG. 3.

Referring to FIG. 5, the frame front wall 13 lies generally in a vertical plane 54 when the frame 12 is installed on a container 29 that is resting on a horizontal shelf 56. The front wall 13 includes a retention panel 60 below the access opening 22. The panel 60 extends across the lower portion of the open face of the container 29 and serves to retain products in the container 29. The retention panel 60 can be integral with or separate from the reminder of the frame 12. The panel 60 is preferably an integral part of the frame 12 and is canted at an angle 62 (see FIG. 5) relative to the vertical plane 54 to present the panel 60 at a convenient viewing angle for customers. The container retention panel 60 preferably includes (see FIG. 1) an information presentation area 64 which can include such information as a picture of the product, the trademark, the price, and functional and technical specifications relating to the product.

Figure 3:
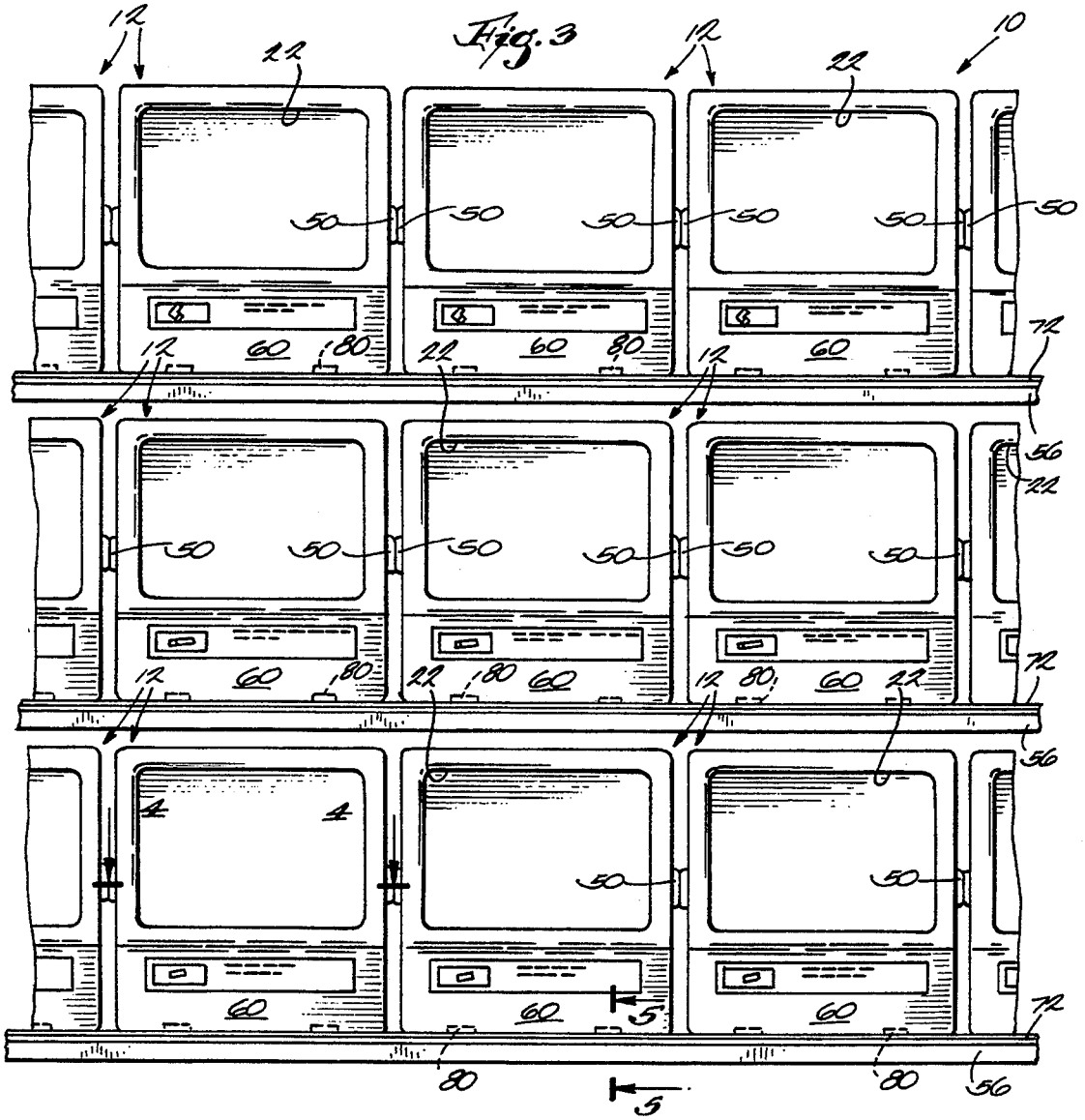
FIG. 3 is an elevational view of a multiplicity of display devices mounted in side-by-side relation on vertically spaced horizontal shelves.

As shown in FIGS. 2 and 5, the display device 10 further includes, for each frame 12, an anchor means 70 for attaching the frame 12 to the shelf 56. The anchor means 70 comprises a base member or strip 72 having (see FIG. 5) upper and lower sides 74 and 76. The upper side 74 has extending upwardly therefrom (see FIG. 2) a longitudinal ridge 78 and spaced bayonet members 80 projecting from the ridge 78. The strip 72 is preferably extruded and the ridge 78 is cut to provide the spaces between the bayonets 80. The lower side of the strip 72 is provided with an attaching means such as a layer of contact sensitive adhesive 81 (FIG. 5) that secures the strip 72 to the shelf 56. The anchor means 70 further includes (see FIGS. 2 and 5) two bayonet receiving apertures 82 in the bottom wall 16 of each frame 12. Each bayonet snaps into a respective aperture 82 to secure the frame 12 to the strip 72. The strip 72 preferably includes a plurality of pairs of bayonets 80 for releasably mounting a plurality of frames 12 in side-by-side relationship on the upper surface of the shelf 56, as shown in FIG. 3. Alternatively, the strip 72 may comprise a plurality of short sections of a length to secure an individual frame 12 to the shelf 56.

To install the display device 10, the strip 72 is placed along the front edge of the horizontally extending shelf 56. The anchor base member 72 is held in position on the shelf by the contact adhesive 81. The top of a shipping container 29 is removed to provide the container 29 with an open face that exposes the products within the container. The frame 12 is placed over the open face of the container 29 with the access opening 22 providing access to the products inside the container. The container 29 and the attached frame 12 are placed on the shelf 56 with the apertures 82 in the frame 12 aligned with two bayonets 80 on the strip 72, and the frame 12 is then pushed downward so that the bayonets 80 snap into the apertures 82 to releasably secure the frame 12 and the container 29 on the shelf 56.

When all of the products have been removed from a specific container, the empty container is removed and replaced by a full container in either of two ways. If the rear of the shelf 56 is not accessible and there is no access to the rear of the container 29, the frame 12 and the container 29 are removed as a unit by first raising the frame 12 upward to disengage the bayonet members 80 on the strip 72. The tab elements 50 facilitate gripping and handling of the frame 12. With the empty container 29 and the frame 12 removed from the shelf, the sides 30 of the empty container 29 are depressed so that the detents 34 are removed from the slots 48, thus releasing the container 29 for removal of the frame 12. The removed frame 12 is then placed over the open face 28 of a new shipping container 29 filled with products. The frame 12 with the attached container 29 is then replaced on the shelf and snapped onto the bayonet members 80 as has been previously described.

If the rear of the shelf 56 is accessible, a service person can reach in from the rear of the container 29, along its sides, and press the side walls 30 inward slightly to disengage the detents 34. This releases the container 12 for withdrawal from the frame 12, which remains on the shelf. A new full container 29 is then inserted into the frame 12 until the detents 34 extend into the slots 48 to hold the full container in place.

The point of sale display, container and shelf assembly secures one or a plurality of shipping containers 29 on the shelf 56 to minimize any risk that the containers 29 will be accidentally dislodged by customers removing products. This substantially eliminates the necessity for products to be removed from containers and individually stacked upon the shelf. Simply removing the top of a container and snapping the frame 12 in surrounding relation to the open face of the container permits the container to be placed on the shelf without any need for removal of the products therein.

We claim:

1. A display device that can be used singularly for securing a single open-faced container on a shelf for display of and access to the container contents or in multiples to secure any number of open-faced containers on a shelf for display of and access to the contents in each container, said device comprising:

a frame defining an access opening, said frame being dimensioned to surround the open face of the container on which the frame is to be mounted;

a releasable locking means on said frame for removably securing said frame to the open-faced container on which said frame is to be mounted; and an anchor means for releasably attaching said frame to the shelf when said display is in use.

2. The display device according to claim 1 wherein said frame includes top, bottom and side walls, said releasable locking means is secured on each of said side walls, and said anchor means is releasably secured on said bottom wall.

3. The display device according to claim 2 wherein each of said walls has inner and outer surfaces, and said releasable locking means is on said inner surface of each of said side walls.

4. The display according to claim 1 wherein said frame includes top, bottom and side walls, and said side walls each include a tab element projecting away from said access opening.

5. The display device according to claim 1 wherein said frame has an inner surface, and wherein said releasable locking means includes a detent projecting toward said access opening and from said frame inner surface for a distance that will result in engagement with the container on which the frame is to be mounted.

6. The display device according to claim 1 wherein said frame includes top, bottom and side walls, and said releasable locking means includes a detent projecting forwardly and inwardly in cantilever fashion from each of said side walls for engagement with the container on which the frame is to be mounted.

7. The display device according to claim 1 wherein said frame includes a rear edge, wherein said releasable locking means comprises a clip member that includes a support surface, a gauge and a detent projecting from said support surface for a distance that will result in engagement of said detent with the container on which the frame is to be mounted, and wherein said clip member is secured to said frame with said gauge in register with said frame rear edge to present said detent at a predetermined position.

8. The display device according to claim 1 wherein said anchor means includes a base member having thereon a bayonet, and an attaching means for attaching said base member on a shelf, and wherein said frame has therein an aperture for releasably receiving said bayonet.

9. The display according to claim 8 wherein said base member has upper and lower sides, wherein said bayonet projects from said base member upper side, and wherein said attaching means includes an adhesive on said base member lower side.

10. The display device according to claim 1 wherein said frame includes a generally vertically disposed container content retention panel below said access opening, said panel extending across a lower portion of the open face of a container on which said frame is mounted.

11. The display device according to claim 10 wherein said frame includes a front wall and said retention panel comprises a portion of said front wall.

12. The display device according to claim 11 wherein said frame front wall lies in a plane, and wherein said retention panel is canted relative to said plane to present said panel at a convenient viewing angle when said frame is on the container.

13. A point of sale display and container assembly mountable on a shelf, said assembly comprising:

a container having side walls and an open face providing access to products within the container;

a frame defining an access opening, said frame being dimensioned to surround said open face;

an anchor means for attaching said frame to the shelf; and a releasable lock for removably securing said frame to one or more of said container walls to allow said container when empty to be removed from said frame and replaced with a full container.

14. The point of sale display and container assembly according to claim 13 wherein said releasable lock includes a recess in one of said container walls and a detent on said frame, said detent being in releasable engagement with said recess for detachably securing said frame to said container.

15. The point of sale display and container assembly according to claim 14 wherein said recess comprises an opening through said container, and wherein said detent projects forwardly and inwardly in cantilever fashion from said frame and through said opening, such that when said frame is slid over said open face of said container said one of said side walls of said container is deflected inwardly by said detent.

16. The point of sale display according to claim 13 wherein said frame includes top, bottom and side walls, wherein said releasable lock secures each of said frame side walls to said container, and wherein said anchor means is releasably secured on said bottom wall.

17. The point of sale display and container assembly according to claim 16 wherein each of said frame side walls has outer and inner surfaces, wherein said releasable lock includes a member on said inner surface of each of said frame side walls, and wherein said anchor means is releasably secured to said outer surface of said bottom wall.

18. The point of sale display and container assembly according to claim 13 wherein said frame includes an aperture, and wherein said anchor means includes a base member which has thereon a bayonet releasably secured in said aperture and which is attached to a shelf when said display is in use.

19. The point of sale display and container assembly according to claim 13 wherein said frame includes a generally vertically disposed container content retention panel below said access opening, said panel extending across a lower portion of the open face of a container on which said frame is mounted.

20. A point of sale display, container and shelf assembly comprising:

a shelf;

a plurality of containers each having sides and an open face providing access to products within the container;

a plurality of frames each mounted on a respective one of said containers, each of said frames having an access opening in register with the open face of the associated container;

a releasable lock for removably securing each of said frames to one or more of said sides of the associated container; and an anchor for removably securing each of said frames on said shelf in side-by-side relation to each other, said anchor including a base having an upper portion releasably attached to each of said frames and a lower portion secured to said shelf, said anchor allowing each of said frames to be removed from said shelf with the associated container attached.

21. The display device according to claim 1 wherein said releasable locking means on said frame removably secures said frame to the open-faced container such that the container is removable from said frame while said frame remains anchored to the shelf.

22. The point of sale display and container assembly according to claim 13 wherein said releasable lock removably secures said frame to one or more of said container walls to allow said container when empty to be removed from said frame while said frame remains anchored to the shelf.

23. The point of sale display, container and shelf assembly according to claim 20 wherein said releasable lock removably secures each of said frames to one or more of said sides of the associated container such that said containers are removable from said frames while said frames remain anchored to said shelf.

24. The point of sale display and container assembly according to claim 17 wherein said anchor means is releasably secured only to said outer surface of said bottom wall.

25. The display device according to claim 1 wherein said anchor means releasably attaches said frame to the shelf such that said frame is removable from said anchor means while said anchor means remains secured to the shelf.

26. The point of sale display and container assembly according to claim 13 wherein said anchor attaches said frame to the shelf such that said frame is removable from said anchor while said anchor remains secured to the shelf.

27. The point of sale display, container and shelf assembly according to claim 20 wherein said anchor removably secures each of said frames on said shelf such that said frames are removable from said anchor while said anchor remains secured to said shelf.

* * * * *